US006261197B1

(12) United States Patent
Grechko

(10) Patent No.: US 6,261,197 B1
(45) Date of Patent: Jul. 17, 2001

(54) GAME BALL

(76) Inventor: Michael Grechko, 26 Morrison Crescent, Kilsyth 3137 (AU)

( * ) Notice: Subject to any disclaimer, the term of this patent is extended or adjusted under 35 U.S.C. 154(b) by 0 days.

(21) Appl. No.: 09/296,320

(22) Filed: Apr. 22, 1999

(51) Int. Cl.[7] ..... A63B 37/14
(52) U.S. Cl. ..... 473/598; 473/600; 473/378
(58) Field of Search ..... D21/708, 713; 473/378, 383, 569, 595, 596, 597, 598, 600, 601, 602, 613, 615, FOR 135, FOR 136, FOR 137

(56) References Cited

U.S. PATENT DOCUMENTS

D. 434,816 * 12/2000 Jobst .
3,819,190 * 6/1974 Nepela et al. .
4,596,389 * 6/1986 Frankowski .
4,874,169 * 10/1989 Litchfield .
5,722,903 * 3/1998 Moriyama et al. .

* cited by examiner

*Primary Examiner*—William M. Pierce

(57) ABSTRACT

A game ball for permitting throwing of curve balls. The game ball includes a resilient inner sphere and an outer covering enclosing the inner sphere. The outer covering has a smooth region and a dimpled region that has a plurality of dimples.

13 Claims, 1 Drawing Sheet

GAME BALL

BACKGROUND OF THE INVENTION

1. Field of the Invention

The present invention relates to balls and more particularly pertains to a new game ball for permitting throwing of curve balls.

2. Description of the Prior Art

The use of balls is known in the prior art. More specifically, balls heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,776,139; U.S. Pat. No. 5,518,234; U.S. Pat. No. 2,683,603; U.S. Pat. No. 4,256,304; U.S. Pat. No. 4,286,738; and U.S. Patent No. Des. 288,462.

While these devices fulfill their respective, particular objectives and requirements, the aforementioned patents do not disclose a new game ball. The inventive device includes a resilient inner sphere and an outer covering enclosing the inner sphere. The outer covering has a smooth region and a dimpled region that has a plurality of dimples.

In these respects, the game ball according to the present invention substantially departs from the conventional concepts and designs of the prior art, and in so doing provides an apparatus primarily developed for the purpose of permitting throwing of curve balls.

SUMMARY OF THE INVENTION

In view of the foregoing disadvantages inherent in the known types of balls now present in the prior art, the present invention provides a new game ball construction wherein the same can be utilized for permitting throwing of curve balls.

The general purpose of the present invention, which will be described subsequently in greater detail, is to provide a new game ball apparatus and method which has many of the advantages of the balls mentioned heretofore and many novel features that result in a new game ball which is not anticipated, rendered obvious, suggested, or even implied by any of the prior art balls, either alone or in any combination thereof.

To attain this, the present invention generally comprises a resilient inner sphere and an outer covering enclosing the inner sphere. The outer covering has a smooth region and a dimpled region that has a plurality of dimples.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new game ball apparatus and method which has many of the advantages of the balls mentioned heretofore and many novel features that result in a new game ball which is not anticipated, rendered obvious, suggested, or even implied by any of the prior art balls, either alone or in any combination thereof.

It is another object of the present invention to provide a new game ball which may be easily and efficiently manufactured and marketed.

It is a further object of the present invention to provide a new game ball which is of a durable and reliable construction.

An even further object of the present invention is to provide a new game ball which is susceptible of a low cost of manufacture with regard to both materials and labor, and which accordingly is then susceptible of low prices of sale to the consuming public, thereby making such game ball economically available to the buying public.

Still yet another object of the present invention is to provide a new game ball which provides in the apparatuses and methods of the prior art some of the advantages thereof, while simultaneously overcoming some of the disadvantages normally associated therewith.

Still another object of the present invention is to provide a new game ball for permitting throwing of curve balls.

Yet another object of the present invention is to provide a new game ball which includes a resilient inner sphere and an outer covering enclosing the inner sphere. The outer covering has a smooth region and a dimpled region that has a plurality of dimples.

Still yet another object of the present invention is to provide a new game ball that eliminates the need to have a thrower snap his or her wrist to throw a curve ball.

Even still another object of the present invention is to provide a new game ball that may be used to teach batters to hit curve balls.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
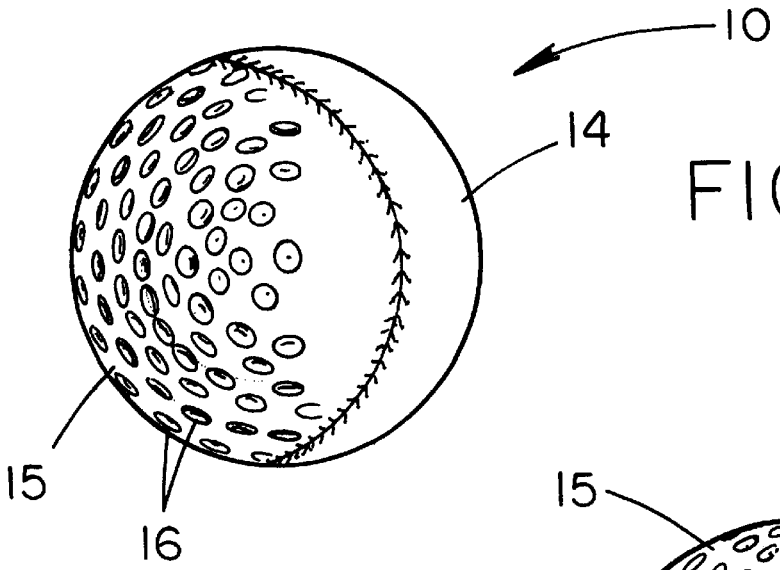
FIG. 1 is a schematic side view of a new game ball according to the present invention.
Figure 2:
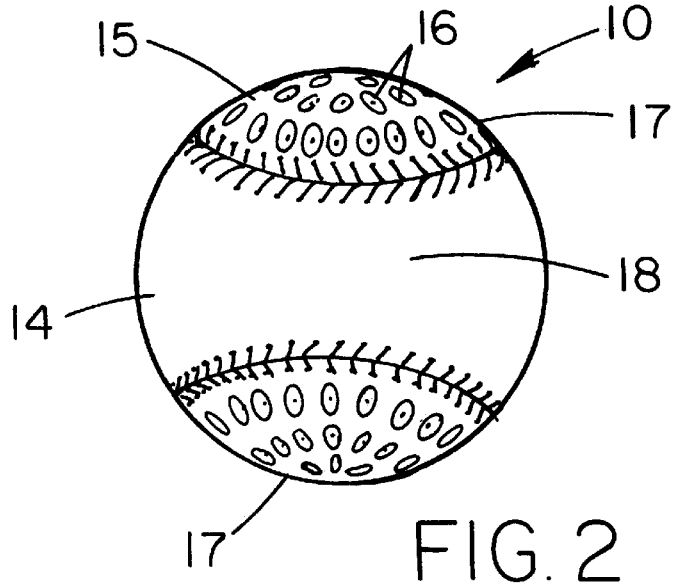
FIG. 2 is a schematic side view of the present invention designed for baseball.
Figure 3:
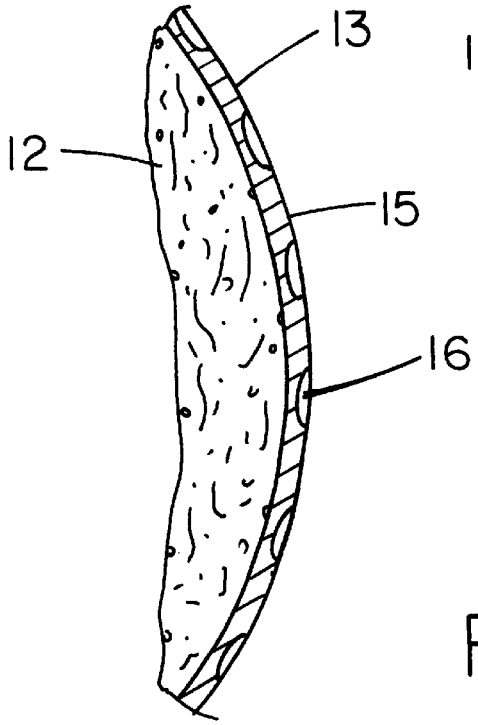
FIG. 3 is a schematic partial cross sectional view of the present invention.

With reference now to the drawings, and in particular to FIGS. 1 through 3 thereof, a new game ball embodying the principles and concepts of the present invention and generally designated by the reference numeral 10 will be described.

As best illustrated in FIGS. 1 through 3, the game ball 10 generally comprises a resilient inner sphere 12 and an outer covering 13 enclosing the inner sphere. The outer covering has a smooth region 14 and a dimpled region 15 that has a plurality of dimples 16 on its outer surface.

Preferably, the inner sphere is molded and made from resilient polyurethane foam. Also preferably, the outer covering is made from leather or plastic.

Ideally, the dimpled region comprises half of the outer covering. The smooth region would then also comprise half of the outer covering.

In a first embodiment, as shown in FIG. 1, the smooth region is hemispherical. The dimpled region is also hemispherical. Preferably, the dimpled region has a center. The dimples arc arranged in concentric annular rows coaxial with the center of the dimpled region. Also preferably, an outer diameter of the outer covering is dimensioned substantially the same as a cricket ball.

In an alternate embodiment, as seen in FIG. 2, the smooth region and the dimpled region each have bulbous outer portions 17 connected by a middle portion 18 such that the smooth and dimpled regions each have a generally bow tie shaped outer periphery. Each of the outer portions of the dimpled region has a center. Preferably, the dimples on each outer portion are arranged in concentric annular rows coaxial with the center of the associated outer portion. Preferably, an outer diameter of the outer covering is dimensioned substantially the same as a baseball.

Ideally, half of the dimples on the middle portion are in rows concentric with one of the centers of the outer portions. The other half of the dimples on the middle portion are in rows concentric with the center of the other outer portion.

Preferably, in either embodiment, the smooth and dimpled regions are stitched together with a strong thread.

In either embodiment, each of the dimples may round like a golf ball's dimples, or oblong shaped. Another alternative embodiment would have oblong dimples in the annular row positioned towards the outer periphery of the dimpled portion with the rest of the dimples being round. Ideally, as illustrated in FIG. 3, each of the dimples extends about half way through the outer covering.

In use, a user throws the ball. As the ball travels through the air, the dimples disrupt air flow over the dimpled portion, enhancing lift and drag factors. The enhanced lift and drag factors cause the ball to curve from a straight trajectory in the direction thrown.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A ball, comprising:

a resilient inner sphere; and an outer covering enclosing said inner sphere and having a smooth region and a dimpled region, said dimpled region having a plurality of dimples;

said smooth region and said dimpled region each having bulbous outer portions connected by a middle portion such that said smooth and dimpled regions each have a generally bow tie shaped outer periphery.

2. The ball of claim 1, wherein said dimpled region comprises half of said outer covering.

3. The ball of claim 1, wherein said smooth region is hemispherical, said dimpled region being hemispherical.

4. The ball of claim 3, wherein said dimpled region has a center, wherein said dimples are arranged in concentric annular rows coaxial with said center of said dimpled region.

5. The ball of claim 4, wherein the dimples in an annular row positioned towards the outer periphery of the dimpled portion are oblong, the remainder of the dimples being round.

6. The ball of claim 1, wherein an outer diameter of said outer covering is dimensioned substantially the same as a cricket ball.

7. The ball of claim 1, wherein each of said outer portions of said dimpled region have a center, wherein said dimples on each outer portion are arranged in concentric annular rows coaxial with said center of the associated outer portion.

8. The ball of claim 7, wherein the dimples in an annular row positioned towards the outer periphery of the dimpled portion are oblong, the remainder of the dimples being round.

9. The ball of claim 1, wherein an outer diameter of said outer covering is dimensioned substantially the same as a baseball.

10. The ball of claim 1, wherein said smooth and dimpled regions are stitched together.

11. The ball of claim 1, wherein each of said dimples is round.

12. The ball of claim 1, wherein each of said dimples is oblong shaped.

13. The ball of claim 1, wherein each of said dimples extend about half way through said outer covering.

* * * * *